US008174550B2

(12) United States Patent
Mori

(10) Patent No.: US 8,174,550 B2
(45) Date of Patent: May 8, 2012

(54) PRINTER

(75) Inventor: Hiroyuki Mori, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 254 days.

(21) Appl. No.: 12/712,507

(22) Filed: Feb. 25, 2010

(65) Prior Publication Data

US 2010/0220170 A1 Sep. 2, 2010

(30) Foreign Application Priority Data

Feb. 27, 2009 (JP) ..... 2009-046621

(51) Int. Cl.
*B41J 2/325* (2006.01)
*B41J 2/32* (2006.01)

(52) U.S. Cl. ..... 347/213

(58) Field of Classification Search ..... 347/213, 347/215, 217, 218; 400/120.01
See application file for complete search history.

(56) References Cited

U.S. PATENT DOCUMENTS 6,693,655 B2 * 2/2004 Fujimoto et al. ..... 347/213
6,781,615 B2 * 8/2004 Tsuruta ..... 347/213
6,801,236 B2 10/2004 Araki et al.
6,873,348 B1 * 3/2005 Isono et al. ..... 347/213
7,133,059 B2 * 11/2006 Mochizuki et al. ..... 347/213
7,173,643 B2 * 2/2007 Kubota et al. ..... 347/213
2003/0025780 A1 * 2/2003 Fujimoto et al. ..... 347/213

FOREIGN PATENT DOCUMENTS

JP 2002292916 A 10/2002
JP 2003048336 A 2/2003

OTHER PUBLICATIONS

Machine-generated translation of JP 2002-292916, published on Sep. 2002.*

* cited by examiner

*Primary Examiner* — Huan Tran
(74) *Attorney, Agent, or Firm* — Pillsbury Winthrop Shaw Pittman, LLP

(57) ABSTRACT

A printer includes a feeding unit, a conveying unit, a print unit to print information on an intermediate transfer film or a print medium, a transfer unit to transfer the information printed on the intermediate transfer film to a transferred article, a winding unit, a discharge unit, a detection unit structured so as to detect the intermediate transfer film or the print medium and inform the detection information to a setting unit, and the setting unit to decide an intermediate transfer film mode to operate the feeding unit, conveying unit, print unit, transfer unit, and winding unit when the detection information sent from the detection unit indicates that the intermediate transfer film is detected or decide a direct medium mode to operate the feeding unit, conveying unit, print unit, and discharge unit when the detection information sent from the detection unit indicates that the print medium is detected.

2 Claims, 5 Drawing Sheets

PRINTER

CROSS REFERENCE TO RELATED APPLICATION

This application is based upon and claims the benefit of priority from Japanese Patent. Application No. 2009-046621, filed on Feb. 27, 2009, the entire contents of which are incorporated herein by reference.

BACKGROUND OF THE INVENTION

1. Field of the Invention

The invention relates to a printer to print by switching the print system according to characteristics of a print medium or printing information and more particularly to a printer using a heat transfer system.

2. Description of the Related Art

The heat transfer system of the printer includes a direct transfer system and an intermediate transfer system. In the direct transfer system, a thermal head makes contact with a print medium via a heat transfer film and directly transfers ink of the heat transfer film to the print medium according to the information such as an image and characters.

The direct transfer system uses heat sublimate ink. The heat sublimate ink is excellent in gradation expression due to the ink characteristics. Accordingly, the direct transfer system has an advantage of obtaining a high-quality image. However, the direct transfer system requires a reception layer to receive ink on the surface of a print medium to which an image is transferred. Therefore, the print medium is limited in the direct transfer system. Or, an ink reception layer must be formed on the surface of the print medium in the direct transfer system.

The intermediate transfer system eliminates such faults. In the intermediate transfer system, an image is transferred once to an intermediate transfer film, and then the image is re-transferred to a transferred article at the transfer unit.

The intermediate transfer system has an advantage that the ink reception layer is not indispensable for a print medium. Further, the intermediate transfer system has an advantage that the fault at time of image transfer onto the uneven portion of the surface of the print medium is removed. Furthermore, the intermediate transfer system, compared with the direct transfer system, has an advantage that the overall of a card print medium can be printed easily.

On the other hand, the intermediate transfer system requires an intermediate transfer film. Therefore, the intermediate transfer system has a disadvantage that the running cost is higher than the running cost of the direct transfer system. Further, a transfer unit uses a heater, so that the intermediate transfer system has a disadvantage that the start time of the printer is long. Therefore, either of both systems has merits and demerits.

Therefore, Japanese Patent Application Disclosure 2002-292916 and Japanese Patent Application Disclosure 2003-048336, for example, disclose a printer to switch the print system between the direct transfer system and the intermediate transfer system according to characteristics of a print medium and an object. The printer can print on the print medium with an optimum print system and furthermore can decrease the running cost accompanying printing.

However, the printer disclosed in Japanese Patent Application Disclosure 2002-292916 includes individually a direct transfer unit and an indirect transfer unit. And, an operator attaches selectively the units to the mounting unit of the printer and switches the print system to the intermediate transfer system or the direction transfer system. Therefore, a problem arises in the printer that the operator needs a unit exchange operation and the exchange operation requires much labor and time.

Further, the printer disclosed in Japanese Patent Application Disclosure 2003-048336 includes a drive system of an intermediate transfer ribbon and a drive system of a direct print medium. The drive units switches the print system to the intermediate transfer system or the direct transfer system under the switching control. Therefore, a problem arises in the printer that the constitution is complicated and the cost is high.

BRIEF SUMMARY OF THE INVENTION

An embodiment of the invention is intended to provide a printer capable of easily switching the print system to intermediate transfer print or to direct print by a brief constitution.

The printer as an embodiment of the invention is composed of a feeding unit structured so as to feed an intermediate transfer film or a print medium, a conveying unit structured so as to convey the intermediate transfer film or the print medium, a print unit to print information on the intermediate transfer film or the print medium, a transfer unit to transfer the information printed on the intermediate transfer film to a transferred article, a winding unit structured so as to windup the intermediate transfer film, a discharge unit to discharge the print medium or the transferred article on which the information is printed, a detection unit structured so as to detect whether the fed article is the intermediate transfer film or the print medium and inform the detection information to a setting unit, and the setting unit to decide an intermediate transfer film mode to operate the feeding unit, conveying unit, print unit, transfer unit, and winding unit on the basis of that the fed article is the intermediate transfer film from the detection information sent from the detection unit or decide a direct medium mode to operate the feeding unit, conveying unit, print unit, and take-out unit on the basis of that the fed article is the print medium from the detection information sent from the detection unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, embodiments of the invention will be described with reference to the drawings.

Figure 1:
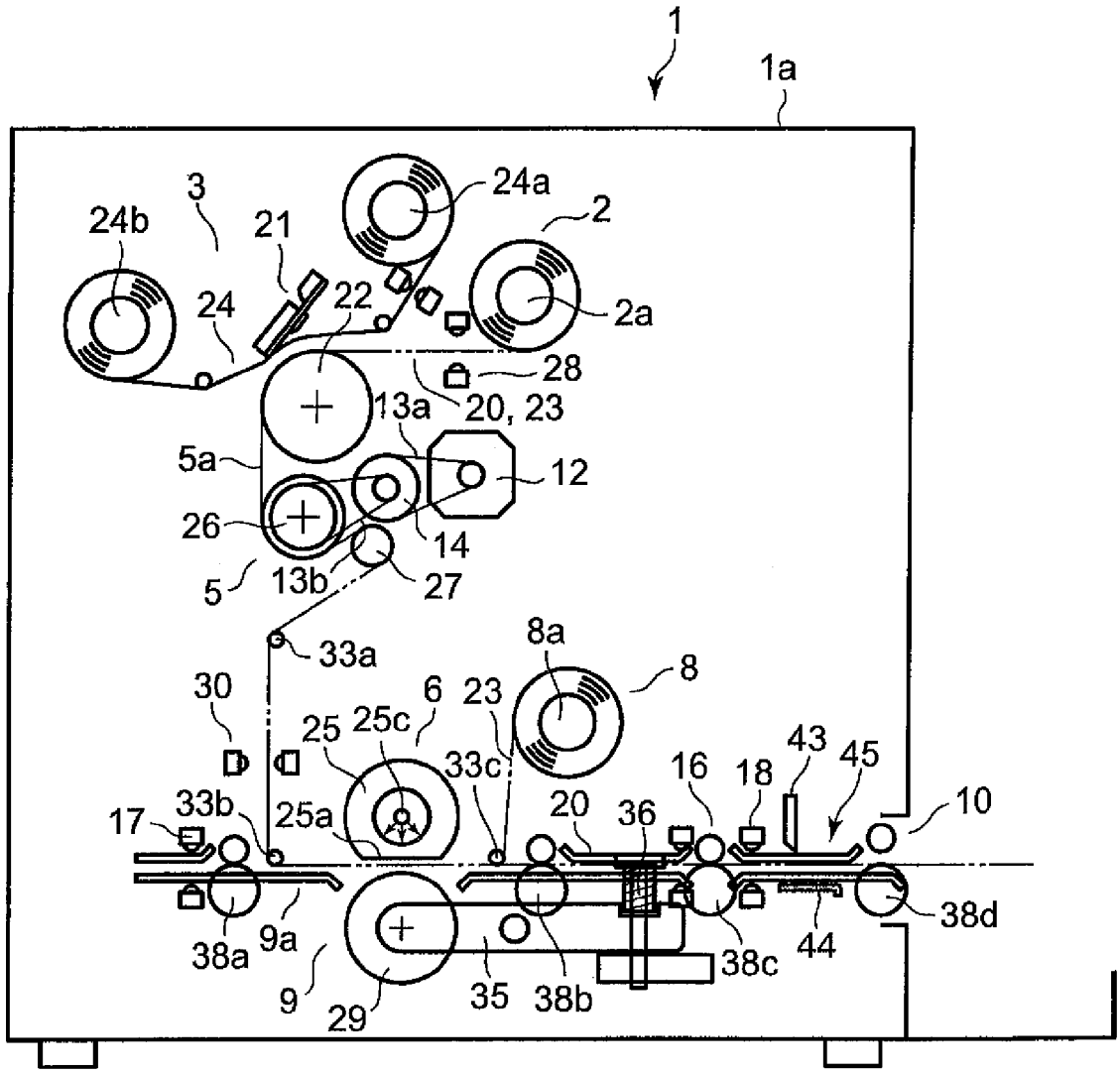
FIG. 1 shows the printer which is an embodiment of the invention.

FIG. 1 shows a printer 1 of an embodiment of the invention.

The printer 1 includes a main body 1*a*. A feed unit 2 and a print unit 3 are installed on the upper side in the main body 1*a*. The feed unit 2 can be equipped with a print medium 20 on which information is printed directly and an intermediate transfer film 23. Furthermore, the feed unit 2 feeds the attached print medium 20 and the intermediate transfer film 23. The print unit 3 prints an image on the print medium 20 and the intermediate transfer film 23 which are fed from the feed unit 2.

A print medium conveying unit 5 is installed on the lower portion of the print unit 3. The print medium conveying unit 5 conveys the print medium 20 and the intermediate transfer film 23 which are fed from the feed unit 2 via a conveying path 5*a*.

Further, a transfer unit 6 and a winding unit 8 are installed on the lower side in the main body 1*a*. The transfer unit 6 transfers an image printed on the intermediate transfer film 23 to a transferred article 31 which will be described later. Further, the winding unit 8 winds up the intermediate transfer film 23 after image transfer.

Furthermore, a transferred article conveying unit 9 is installed on the lower side in the main body 1*a*. The transferred article conveying unit 9 conveys the transferred article 31 along a conveying path 9*a*.

Further, a gateway 10 is installed on the lower side of the front of the main body 1*a*. The gateway 10 is a hole to take the transferred article 31 into the main body 1*a*. Further, the gateway 10 is also a hole to take out the transferred article 31 from the main body 1*a*. Furthermore, the gateway 10 is also a hole to discharge the print medium 20.

Next, the feed unit 2, the print unit 3, the print medium conveying unit 5, the transfer unit 6, the winding unit 8, and the transferred article conveying unit 9 will be described in detail.

The feed unit 2 is composed of a hub 2*a* and a DC motor (not drawn).

The print medium 20 and the intermediate transfer film 23 are a roll-shaped medium. A direct print medium detection mark not drawn is put on the print medium 20.

The print medium 20 or intermediate transfer film 23 is selectively installed in the feed unit 2.

The DC motor is connected to the hub 2*a* using a torque limiter. The DC motor rotates the hub 2*a* in the opposite direction to the printing direction. The hub 2*a* transfers the rotary power to the print medium 20 and intermediate transfer film 23. Therefore, when the print medium 20 and intermediate transfer film 23 are conveyed in the printing direction, the hub 2*a* gives tension set by slip torque of the torque limiter to the intermediate transfer film 23.

Further, when the print medium 20 and the intermediate transfer film 23 are conveyed in the opposite direction to the printing direction, the hub 2*a* operates so as to wind up the print medium 20 and the intermediate transfer film 23.

A transfer ribbon is used as an intermediate transfer film 23. The transfer ribbon is composed of a hologram layer and an image-receiving adhesion layer which are coated sequentially on the surface of a long base layer.

The print medium 20 is roll paper or a roll label, for example.

The roll paper is long paper wound in a roll shape. A timing mark to detect the conveying position is pre-printed on the roll paper. Further, the roll paper may be perforated to enable easy separation.

The roll label is composed of labels continuously affixed on paper the surface of which is coated with a release agent. A timing mark to detect the conveying position is pre-printed on the roll label. Further, the roll label may be perforated to enable easy separation.

The print unit 3 includes a thermal head 21. A molten ink ribbon 24 is opposite to the thermal head 21.

An example of the molten ink ribbon 24 is a ribbon with molten ink of each color such as Y (yellow), M (magenta), C (cyan), and K (black) coated alternately.

For the thermal head 21, a line thermal head composed of heating units arranged in one row is used and a near edge type or corner edge type thermal head is preferable.

The thermal head 21 is arranged perpendicularly to the conveying direction of the print medium 20 or intermediate transfer film 23.

The thermal head 21 is used to print due to peeling-off during hot state.

The one end side of the molten ink ribbon 24 is wound round a feed roller 24*a*. The other end side of the molten ink ribbon 24 is wound round a feed roller 24*b*.

Further, the thermal head 21 is opposite to a platen roller 22 via the molten ink ribbon 24.

The print medium (or the intermediate transfer film 23) is arranged between the molten ink ribbon 24 and the platen roller 22.

The thermal head 21 forms a color image or black characters on the print medium 20 (or the intermediate transfer film 23) by the molten ink ribbon 24.

Further, the molten ink ribbon 24, for example, is composed of functional ribbon materials such as a ribbon only of monochromatic ink, fluorescent pigment ink emitting light due to ultraviolet rays, a printing metallic thin film (aluminum evaporation) layer having a glossy surface, and a printing hologram layer.

The print medium conveying unit 5 is composed of a drive roller 26, a tensioner 27, and guide rollers 33*a* to 33*c*.

The print medium 20 (or the intermediate transfer film 23) spreads over the drive roller 26.

The drive force to convey the print medium 20 (or the intermediate transfer film 23) is generally given from the platen roller 22 having an installed drive mechanism. However, the friction coefficient between the print medium 20 (or the intermediate transfer film 23) and the platen roller 22 is not increased due to the hardness and smoothness of the platen roller 22. Further, there is a case in which the friction coefficient between the print medium 20 (or the intermediate transfer film 23) and the platen roller 22 is not stabilized due to the hardness and smoothness.

Therefore, the drive roller 26 is installed at a short distance from the platen roller 22 on the downstream side (on the side of a heat roller 25 which will be described later).

It is improved as has the winding angle with the drive roller 26 increases.

In the embodiment, the winding angle of the print medium 20 (or the intermediate transfer film 23) is from 90° to 130°.

The tensioner 27 is equipped with a spring mechanism (not drawn). The tensioner 27 gives tension to the print medium 20 (or the intermediate transfer film 23) within a limited working range.

The drive roller 26 is driven to rotate in combination of a 5-phase stepping motor 12 with a reduction mechanism and can convey precisely the print medium 20 (or the intermediate transfer film 23). The reduction mechanism is composed of a timing belt 13*a*, a pulley 14, and a timing belt 13*b*.

The transfer unit 6 includes the heat roller 25 and a backup roller 29. The heat roller 25 has a flat cut surface 25*a* at a portion of the circumference and internally includes a heater 25*c*. The heat roller 25 is made of a metal.

The backup roller 29 is opposite to the heat roller 25 via the print medium 20 or the intermediate transfer film 23.

Figure 2:
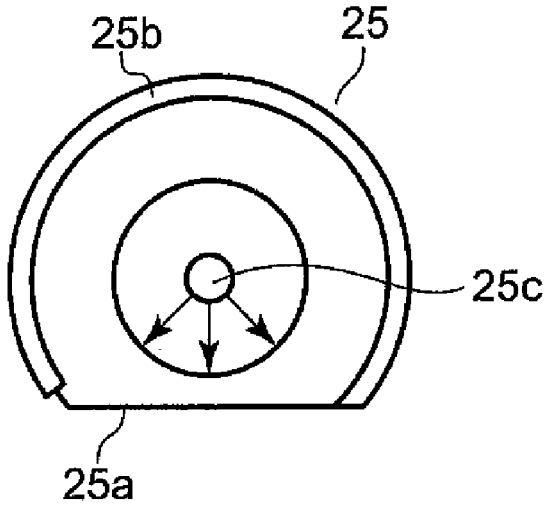
FIG. 2 is a drawing showing the heat roller of the printer shown in FIG. 1.

The circular arc portion of the heat roller 25 is shown in FIG. 2. Heat-resistant rubber 25*b* with a thickness of 1 mm to 2 mm covers the circular arc portion of the heat roller 25. Further, the heat-resistant rubber 25*b* may cover not only the circular arc portion of the heat roller 25 but also the flat cut surface 25*a*.

The circumferential length of the circular arc portion of the heat roller 25 is equal to the distance at the length of the transfer operation to the transferred article such as a booklet or a cutform.

The initial position of the heat roller 25 is a position where the flat cut surface 25*a* of the heat roller 25 is parallel with a transfer medium conveying path 9*a* which will be described later. In the initial position of the heat roller 25, a gap is formed between the heat roller 25 and the backup roller 29. Further, in the initial position of the heat roller 25, the intermediate transfer film 23 is positioned at a place where the heat roller 25 and backup roller 29 are not in contact with each other.

Furthermore, when the transferred article enters in the state of the initial position, the transferred article and the intermediate transfer film 23 are preferably positioned in a place where the surface of the transferred article and the surface of the intermediate transfer film 23 are not in contact with each other.

The heat roller 25 is connected to a DC servomotor or a stepping motor. The heat roller 26 drives accurately at a fixed speed.

The backup roller 29 is attached on the side of one end of a support lever 35. The backup roller 29 is rotatable. The support lever 35 is supported rotatably at the middle of the support lever. A coil spring 36 elastically presses down the side of the other end of the support lever 35. At the time of transfer from the intermediate transfer film 23 to the transferred article, the coil spring 36 presses down the side of the other end, thus the backup roller 29 is pressurized to the heat roller 25. On the upstream side of the intermediate transfer film 23 fed between the heat roller 25 and the backup roller 29 in the feeding direction, a mark sensor 30 is installed.

The winding unit 8 of the intermediate transfer film 23 is composed of a winding hub 8*a* and a pulse motor (not drawn).

The winding hub 8*a* transmits the rotary force to the intermediate transfer film 23 set in the printer. The pulse motor is connected to the winding hub 8*a* via a torque limiter.

A peeling-off shaft 33*c* is arranged between the heat roller 25 and the winding hub 8*a*. The peeling-off shaft 33*c* guides conveyance of the intermediate transfer film 23.

The transferred article to which an image is transferred is conveyed by a pair of conveying rollers 38*a*. The intermediate transfer film 23 is guided by the peeling-off shaft 33*c* and is wound round the winding hub 8*a*. As a result, the image receiving layer and hologram layer which are transferred to the transferred article are peeled off from the base layer of the intermediate transfer film 23.

The transferred article conveying unit 9 includes pairs of conveying rollers 38*a* to 38*d*.

The pairs of conveying rollers 38*a* to 38*d* hold and convey the transferred article along the conveying path 9*a*. Further, when the print medium 20 is set as a print medium, the transferred article conveying unit 9 conveys the print medium 20 by the pairs of conveying rollers 38*a* to 38*d*. Namely, the pairs of conveying rollers 38*a* to 38*d* of the transferred article conveying unit 9 are also used as a print medium conveying unit 16 to convey the print medium 20. The pulse motor (not drawn) drives to rotate the pairs of conveying rollers 38*a* to 38*d*. Further, a transmissive sensor 17 is installed in the neighborhood of the pair of conveying rollers 38*a*. The transmissive sensor 17 detects the position of the transferred article.

The intermediate transfer film 23 is attached to the feed unit 2 on the side of one end. The middle portion of the intermediate transfer film 23 spreads over the platen roller 22, the drive roller 26, the tensioner 27, and the guide rollers 33*a* to 33*c*. The side of the other end of the intermediate transfer film 23 is attached to the winding unit 8. The intermediate transfer film 23 is set in the printer 1 in this way.

Further, the print medium 20 is attached to the feed unit 2 on the side of one end. The middle portion of the print medium 20 spreads over the platen roller 22, the drive roller 26, the tensioner 27, and the guide rollers 33*a* to 33*c*. The side of the other end of the print medium 20 is positioned between the pairs of conveying rollers 38*a* to 38*d*. The print medium 20 is set in the printer 1 in this way.

A sensor 18 is installed in the print medium conveying unit 16. The sensor 18 is positioned in the neighborhood of the pair of conveying rollers 38*c*.

The sensor 18 detects whether the print medium 20 is set or not. A transmissive sensor, a reflection type sensor, or contact type sensor is used for the sensor 18.

Figure 3:
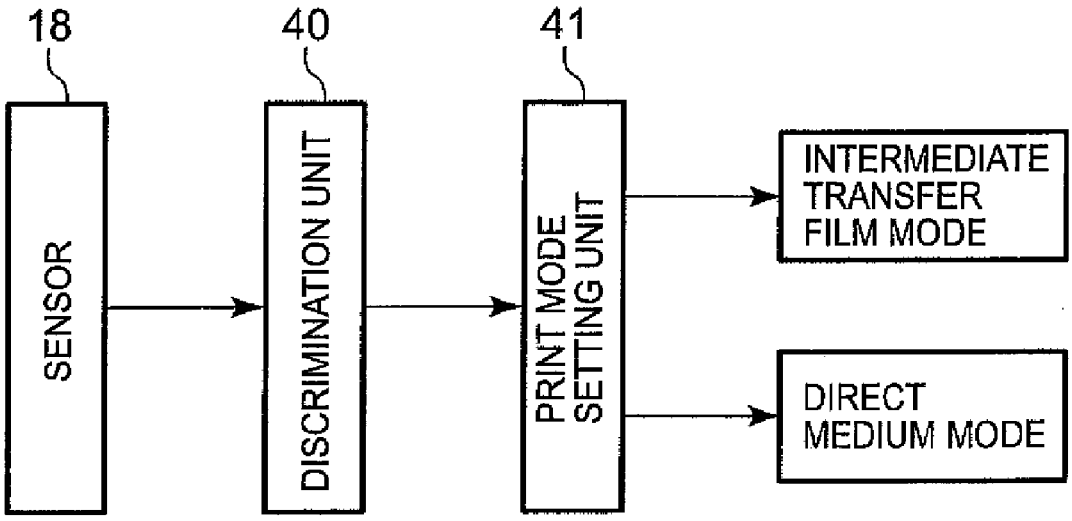
FIG. 3 is a block diagram showing the control system of the print mode setting unit shown in FIG. 1.

The setting of the print mode based on the sensor 18 is shown in FIG. 3. The sensor 18 is connected to a discrimination unit 40 via a transmission circuit (not drawn). A print mode setting unit 41 is connected to the discrimination unit 40.

When the sensor 18 detects the direct print medium detection mark, the sensor 18 transmits the detection information to the discrimination unit 40. When the discrimination unit 40 discriminates that the print medium 20 is set on the basis of the detection information, the discrimination unit 40 outputs the discrimination results to the print mode setting unit 41. The print mode setting unit 41 sets the print mode on the basis of the discrimination results. In this case, the discrimination results indicate that the print medium 20 is set, so that the print mode setting unit 41 sets the print mode to the direct medium mode. The direct print mode is a print mode to operate the feed unit 2, the print medium conveying unit 5, the print unit 3, and the direct print medium conveying unit 16.

Further, when the intermediate transfer film 23 is set, the sensor 18 cannot detect the direct print medium detection mark even if a predetermined period of time elapses and transmits no detection signal to the discrimination unit 40. In this case, the discrimination unit 40 discriminates that the intermediate transfer film 23 is set and outputs the discrimination results to the print mode setting unit 41. The print mode setting unit 41 sets an intermediate transfer film mode on the basis of the discrimination results of the discrimination unit 40. The intermediate transfer film mode is a print mode to operate the feed unit 2, the print medium conveying unit 5, the print unit 3, the transfer unit 6, and the winding unit 8.

The sensor 18 is installed not only in the neighborhood of the direction print medium conveying unit 16 but also in the neighborhood of the winding unit 8 of the intermediate transfer film 23. Therefore, the sensor 18 can detect directly the intermediate transfer film 23 set in the winding unit 8.

Further, a print medium cutting unit 45 is arranged in the print medium conveying unit 16. The print medium cutting unit 45 is composed of a fixed blade 43 and a moving blade 44.

The print medium cutting unit 45 forms a cutform. The print medium 20 passes between the fixed blade 43 and the moving blade 44. The print medium 20 is cut off in a predetermined length by rotation of the moving blade 44 to form a cutform.

Next, the printing operation will be described.

Figure 4:
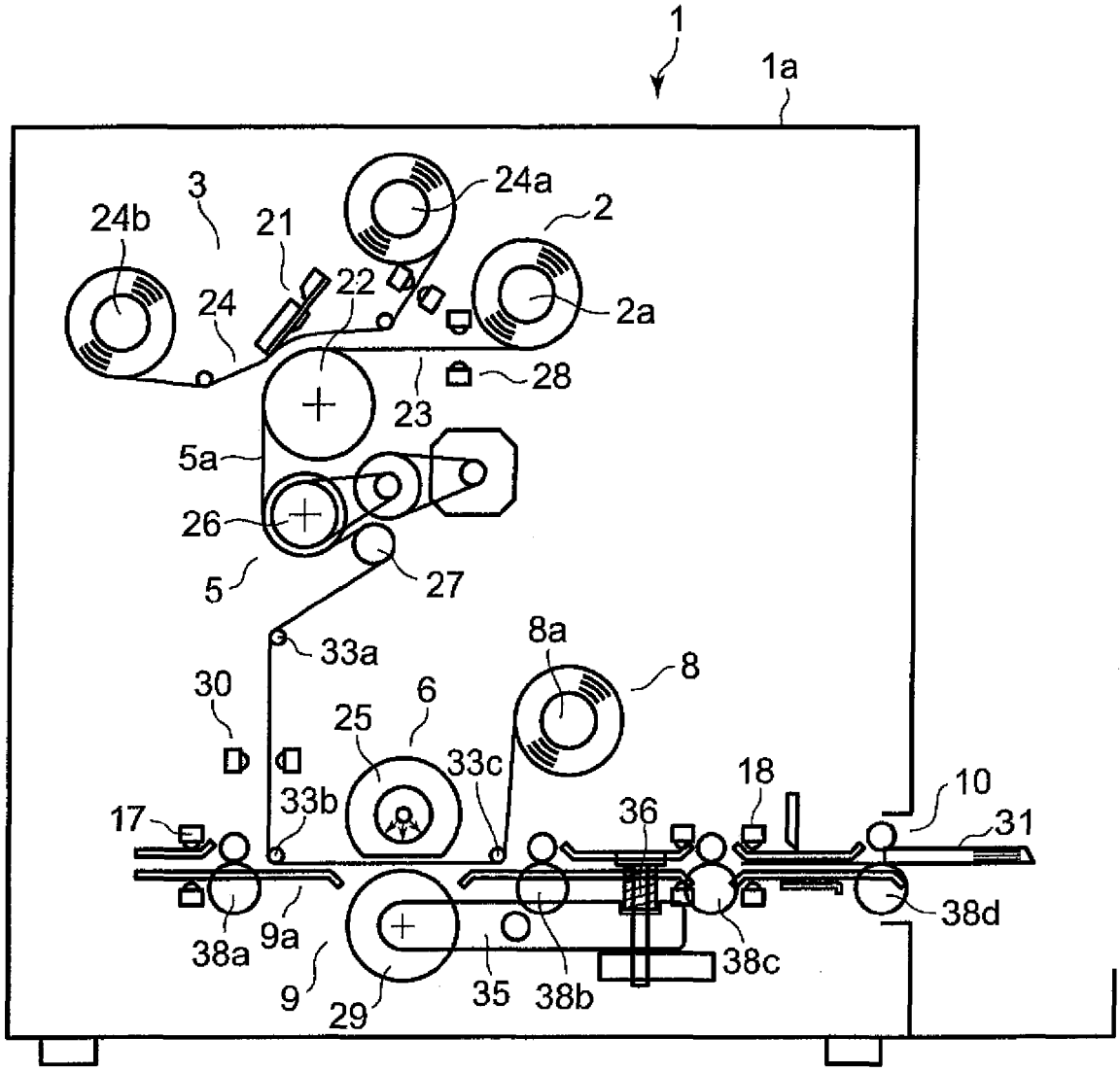
FIG. 4 shows the printing operation by the intermediate transfer system of the printer shown in FIG. 1.

Firstly, the case of execution of intermediate transfer print will be described with reference to FIG. 4.

An operator opens a door of the printer 1 and sets the intermediate transfer film 23. If the operator closes the door after the intermediate transfer film 23 is set, the printer 1 operates and the sensor 18 starts operation. Even if a predetermined period of time elapses, no detection information is transmitted from the sensor 18 to the discrimination unit 40. Namely, the discrimination unit 40 receives detection information meaning that the intermediate transfer film 23 is detected. Therefore, the discrimination unit 40 discriminates that the intermediate transfer film 23 is set. The print mode setting unit 41 sets the intermediate transfer film mode on the basis of the discrimination results. Then, the heat roller 25 of the transfer unit 6 is started. In the case, at the initial position of the heat roller 25, the flat cut surface 25*a* of the heat roller 25 is parallel with the transferred article conveying path 9*a*.

The operator instructs print start in the state. The intermediate transfer film 23 is discharged from the feed unit 2. The hologram position mark put on the discharged intermediate transfer film 23 is detected by a mark sensor 28. The intermediate transfer film 23 is controlled so as to be set at the print start position on the basis of the detection results. The thermal head 21 generates heat in the state on the basis of the print information. The intermediate transfer film 23 is printed with the print information at a predetermined position by the molten ink ribbon 24. The print is color print.

The color print is printed by 4-color superimposition of the three primary colors of Y, M, and C added with black. The intermediate transfer film 23 is color-printed by a superimposition printing method to permit the intermediate transfer film 23 to move back and forth across the thermal head 21 by the same number of times as the number of colors. Further, the information printed is a reversed image.

Further, functional ink such as ink including fluorescent pigment may be given to the print colors in addition to the aforementioned four colors. Further, for the intermediate transfer film 23, instead of color print, the print information may be printed in one color of black.

On the other hand, the transferred article 31 is inserted from the gateway 10. The transferred article 31 is fetched and conveyed. Thereafter, the transmissive sensor 17 decides the position of the transferred article 31. Then, the intermediate transfer film 23 and the transferred article 31 are superimposed with the rotation of the heat roller 25 under the heat roller 25 heated by the heater 25*c*. The conveying direction of the heat roller 25 is opposite to the conveying direction to fetch internally the transferred article 31. The intermediate transfer film 23 and transferred article 31 are pressurized and heated.

Figure 5:
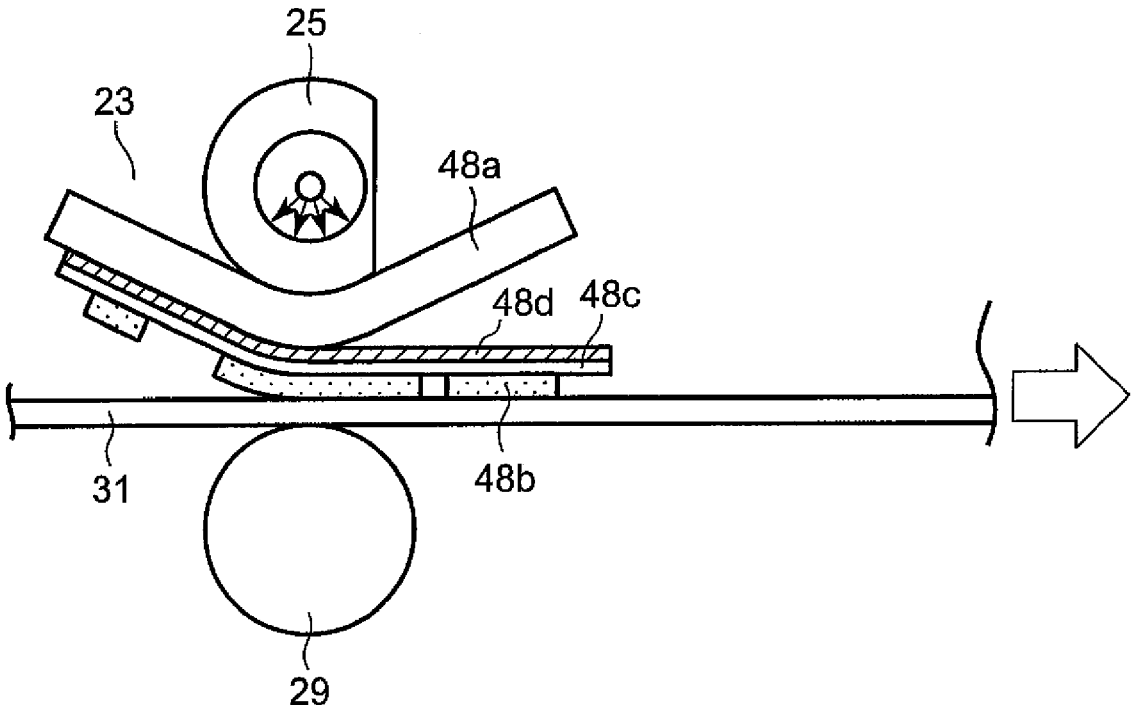
FIG. 5 shows the image transfer operation of the transfer unit shown in FIG. 4.

FIG. 5 shows the situation that a base layer 48*a* of the intermediate transfer film 23 is pulled up at an angle of 60° to 110° with the transferred article 31. And, the transfer of print information 48*b*, an image receiving adhesion layer 48*c*, and a hologram layer 48*d* is completed. The transferred article 31 after completion of the transfer comes out from the gateway 10.

Figure 6:
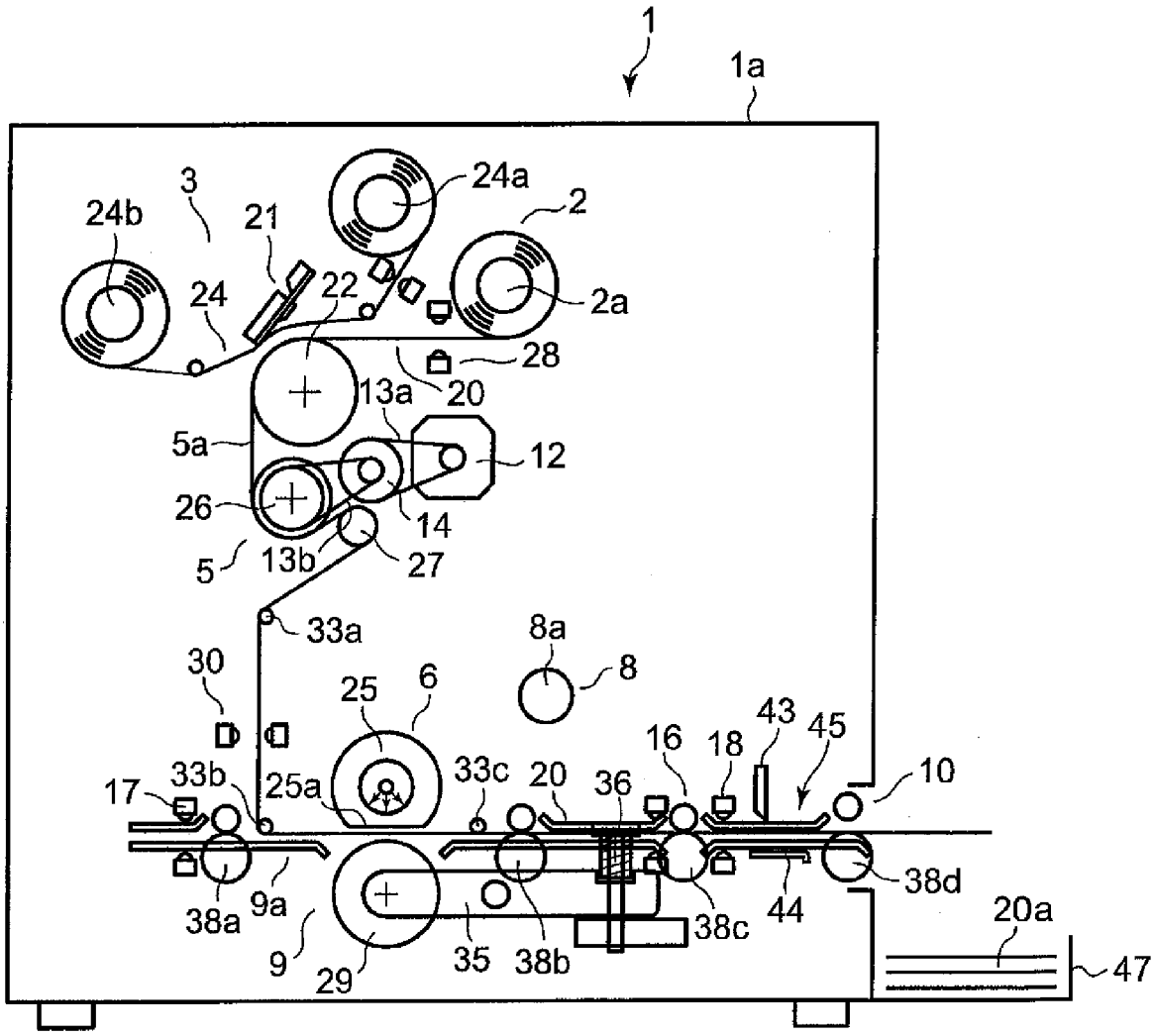
FIG. 6 shows the printing operation by the direct print system of the printer shown in FIG. 1.

Next, the case of execution of direct print will be described with reference to FIG. 6.

Firstly, the operator sets the print medium 20. The set print medium 20 is detected by the sensor 18. The sensor 18 transmits detection information meaning that the print medium 20 is detected to the discriminator unit 40. Then, the discriminator unit 40 discriminates that the print medium 20 is set. The print mode setting unit 41 sets the direct medium on the basis of the discrimination results.

The heat roller 25 of the transfer unit 6 does not start by the setting of the direct medium mode. In the initial position of the heat roller 25, the flat cut surface 25*a* of the heat roller 25 is parallel with the transferred article conveying path 9*a*.

The operator instructs print start in the state. The print medium 20 is discharged from the feed unit 2. The timing mark put on the discharged print medium 20 is detected by the mark sensor 28. The print medium 20 is controlled so as to be set at the print start position on the basis of the detection results. And, the thermal head 21 generates heat on the basis of the print information.

Print information is printed at a predetermined position of the print medium 20 by the molten ink ribbon 24.

The color print is print by 4-color superimposition of the three primary colors of Y, M, and C added with black. The direct print medium 23 is color-printed by a superimposition printing method to permit the print medium 20 to move back and forth across the thermal head 21 by the same number of times as the number of colors.

Further, functional ink such as ink including a fluorescent pigment may be given to the print colors in addition to the aforementioned four colors. Further, for the print medium 20, instead of color print, the print information may be printed in one color of black.

The print medium 20 printed in this way is conveyed by the print medium conveying unit 16. The print medium 20 comes out from the gateway 10.

Further, the case that the printer is set so as to cut the print medium 20 in a cutform shape will be described. In the case, the print medium cutting unit 45 of the print medium conveying unit 16 operates. The print medium 20 is cut off in a predetermined length by the print medium cutting unit 45 to form a cutform. Thereafter, the cutform comes out from the gateway 10. A cutform stacker 47 stores a conveyed cutform 20.

As mentioned above, according to the respective embodiments, the following effects can be obtained.

(1) The operator does not need to exchange the direct transfer unit and indirect transfer unit.

(2) The operator does not need to execute the switching control for the drive system of the intermediate transfer ribbon and the drive system of the direct print medium.

(3) The print system can be switched easily to intermediate transfer print or direct print by use of a brief constitution.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printer comprising:

a feeding unit structured so as to feed an intermediate transfer film or a print medium, a conveying unit structured so as to convey the intermediate transfer film or the print medium, a print unit to print information on the intermediate transfer film or the print medium, a transfer unit to transfer the information printed on the intermediate transfer film to a transferred article, a winding unit structured so as to wind up the intermediate transfer film, a discharge unit to discharge the print medium or the transferred article with the information printed, a detection unit structured so as to detect the intermediate transfer film or the print medium and inform the detection information to a setting unit, and the setting unit to decide an intermediate transfer film mode to operate the feeding unit, the conveying unit, print unit, the transfer unit, and the winding unit when the detection information sent from the detection unit indicates that the intermediate transfer film is detected or decide a direct medium mode to operate the feeding unit, the conveying unit, the print unit, and the discharge unit when the detection information sent from the detection unit indicates that the print medium is detected.

2. A printer according to claim 1, wherein the discharge unit includes a cutting unit to cut off the print medium.

* * * * *